US008485467B2

(12) United States Patent
Gemma

(10) Patent No.: US 8,485,467 B2
(45) Date of Patent: Jul. 16, 2013

(54) AIR INTAKE, IN PARTICULAR FOR AN AIRCRAFT CHAFF DISPENSER

(75) Inventor: Riccardo Gemma, Turin (IT)

(73) Assignee: Alenia Aeronautica S.p.A., Pomigliano d'Arco, Naples (IT)

( * ) Notice: Subject to any disclaimer, the term of this patent is extended or adjusted under 35 U.S.C. 154(b) by 317 days.

(21) Appl. No.: 12/919,690

(22) PCT Filed: Feb. 24, 2009

(86) PCT No.: PCT/IB2009/050732

§ 371 (c)(1),
(2), (4) Date: Aug. 26, 2010

(87) PCT Pub. No.: WO2009/107058

PCT Pub. Date: Sep. 3, 2009

(65) Prior Publication Data

US 2010/0327117 A1 Dec. 30, 2010

(30) Foreign Application Priority Data

Feb. 28, 2008 (IT) ..... TO2008A0142

(51) Int. Cl.
*B64D 1/00* (2006.01)
*B64D 33/02* (2006.01)

(52) U.S. Cl.
USPC ..... 244/53 B; 244/136; 244/121; 244/130

(58) Field of Classification Search
USPC ..... 244/136, 130, 137.1, 53 B, 129.1, 244/121, 1 R; 137/15.1
See application file for complete search history.

(56) References Cited

U.S. PATENT DOCUMENTS 2,694,357 A * 11/1954 Lee ..... 244/130
2,954,948 A * 10/1960 Johnson ..... 244/136
3,099,423 A * 7/1963 Wilde et al. ..... 244/23 R
3,578,264 A * 5/1971 Kuethe ..... 244/130
4,095,761 A * 6/1978 Anderson et al. ..... 244/130

(Continued)

FOREIGN PATENT DOCUMENTS

FR 779 655 A 4/1935

OTHER PUBLICATIONS

"Reducing aircraft drag by drilling holes in wings", Design Engineering, Morgan-Grampian Ltd., London, GB, Mar. 1, 1995, p. 14.

*Primary Examiner* — Tien Dinh
*Assistant Examiner* — Steven Hawk
(74) *Attorney, Agent, or Firm* — Merchant & Gould P.C.

(57) ABSTRACT

An aircraft chaff dispenser includes an elongated hollow housing intended to be fixed to the structure of the aircraft so as to be oriented in the longitudinal direction of the aircraft. The housing has a pair of side walls and the front of each side wall is provided with a pair of lateral air intakes each having a circular through-hole with a diameter d and a fence located behind the hole in the longitudinal direction, or in the direction of travel, of the aircraft at a distance 1 from the center of the hole and having a shape in the form of a horizontally lying V with its vertex directed away from the hole. The diameter d of the hole is between 8 and 12 mm. The ratio h/1 between the height h of the fence at the vertex of the V and the distance 1 is between 0.8 and 1, while the ratio h/d between the height h and the diameter d is between 1.5 and 2.

7 Claims, 1 Drawing Sheet

U.S. PATENT DOCUMENTS

| | | | | |
|---|---|---|---|---|
| 4,167,008 | A * | 9/1979 | Blickenstaff | 342/12 |
| 4,203,566 | A * | 5/1980 | Lord | 244/53 B |
| 4,343,506 | A * | 8/1982 | Saltzman | 244/53 B |
| 4,417,709 | A * | 11/1983 | Fehrm | 244/136 |
| 4,696,442 | A * | 9/1987 | Mazzitelli | 244/53 B |
| 4,836,473 | A * | 6/1989 | Aulehla et al. | 244/130 |
| 5,058,837 | A * | 10/1991 | Wheeler | 244/200.1 |
| 5,271,523 | A * | 12/1993 | Nasvall et al. | 221/185 |
| 5,598,990 | A * | 2/1997 | Farokhi et al. | 244/200.1 |
| 5,841,079 | A | 11/1998 | Parente | |
| 6,079,667 | A * | 6/2000 | Gruensfelder | 244/53 B |
| 6,105,904 | A * | 8/2000 | Lisy et al. | 244/130 |
| 6,142,417 | A * | 11/2000 | Figge, Sr. | 244/53 B |
| 6,247,668 | B1 * | 6/2001 | Reysa et al. | 244/53 B |
| 6,349,899 | B1 * | 2/2002 | Ralston | 244/53 B |
| 6,485,093 | B2 * | 11/2002 | Reivers | 296/217 |
| 6,527,224 | B2 * | 3/2003 | Seidel | 244/53 B |
| 6,619,178 | B1 * | 9/2003 | Fransson et al. | 244/137.1 |
| 6,837,465 | B2 * | 1/2005 | Lisy et al. | 244/204.1 |
| 7,334,760 | B1 * | 2/2008 | Lisy et al. | 244/130 |
| 7,344,107 | B2 * | 3/2008 | Campbell et al. | 244/53 B |
| 7,469,545 | B2 * | 12/2008 | Riley | 244/53 B |
| 7,600,713 | B2 * | 10/2009 | Hein et al. | 244/53 B |
| 7,600,714 | B2 * | 10/2009 | Sheoran et al. | 244/53 B |
| 7,611,093 | B2 * | 11/2009 | Campbell et al. | 244/53 B |
| 7,624,944 | B2 * | 12/2009 | Parikh et al. | 244/53 B |
| 7,665,694 | B2 * | 2/2010 | Hein et al. | 244/53 B |
| 7,849,702 | B2 * | 12/2010 | Parikh | 244/53 B |
| 7,861,968 | B2 * | 1/2011 | Parikh et al. | 244/53 B |
| 7,975,961 | B2 * | 7/2011 | Silkey et al. | 244/53 B |
| 8,172,178 | B2 * | 5/2012 | Bonnaud et al. | 244/200.1 |
| 8,256,706 | B1 * | 9/2012 | Smith et al. | 244/53 B |
| 2002/0134886 | A1 * | 9/2002 | Seidel | 244/53 B |
| 2005/0204910 | A1 * | 9/2005 | Padan | 89/1.813 |
| 2006/0102779 | A1 * | 5/2006 | Campbell et al. | 244/53 B |
| 2006/0163425 | A1 * | 7/2006 | Brown et al. | 244/53 B |
| 2006/0196993 | A1 * | 9/2006 | Hein et al. | 244/53 B |
| 2008/0099630 | A1 * | 5/2008 | Parikh et al. | 244/53 B |
| 2008/0099631 | A1 * | 5/2008 | Parikh et al. | 244/53 B |
| 2008/0179466 | A1 * | 7/2008 | Campbell et al. | 244/53 B |
| 2008/0203218 | A1 * | 8/2008 | Anderson et al. | 244/53 B |

* cited by examiner

AIR INTAKE, IN PARTICULAR FOR AN AIRCRAFT CHAFF DISPENSER

This application is a National Stage Application of PCT/IB2009/050732, filed 24 Feb. 2009, which claims benefit of Ser. No. TO2008A000142, filed 28 Feb. 2008 in Italy and which applications are incorporated herein by reference. To the extent appropriate, a claim of priority is made to each of the above disclosed applications.

FIELD OF THE INVENTION

The present invention relates generally to an air intake and more particularly to an air intake for an aircraft chaff dispenser.

BACKGROUND OF THE INVENTION

Typically an aircraft chaff dispenser includes:

an elongated hollow housing intended to be fixed to the fuselage or to a wing so as to be oriented in the longitudinal direction of the aircraft, the housing having a closed front end and an open rear end;

a driving mechanism received inside the housing and operable to push backwards (relative to the direction of forward movement of the aircraft) packets of chaff and eject them one at a time from the rear opening; and an electronic circuit controlling the driving mechanism, and, where applicable, part of the aircraft defence sensor equipment and electronic circuitry.

The packets of chaff ejected from the rear of the dispenser "explode" as a result of the air striking them and thus disperse the chaff into the air wake of the aircraft.

The main problem affecting the known aircraft chaff dispenser consists in that a negative pressure gradient is created between the front part of the housing (in which the driving mechanism is received) and the rear part of the housing (in which the packets of chaff are received and from which they are ejected), which negative pressure gradient causes the chaff ejected from the chaff dispenser to be sucked back into or recirculated inside it, with a consequent risk of faults both of a mechanical nature, such as seizing of the driving mechanism, and of an electronic nature, in particular problems of electromagnetic interference with the electronic control circuits of the dispenser and with the remaining aircraft defence circuitry and sensor equipment mounted on the housing of the dispenser. In order to overcome this problem it is known to provide air intakes on the front of the side walls of the dispenser housing, so as to increase the pressure at the front of the housing. The presence of lateral air intakes involves, however, the risk that the gases emitted by the missiles launched by the aircraft enter inside the dispenser and hit the packets of chaff contained inside it, damaging them irremediably and therefore negatively affecting the defence capacity of the aircraft.

SUMMARY OF THE INVENTION

The object of the present invention is therefore to provide an air intake which is able to overcome the drawbacks of the prior art discussed above.

By virtue of the fact that the air intake comprises a through-hole formed in a wall of a housing and a fence which is suitably shaped and suitably spaced from the hole, the pressure increase effect is maximized in the part of the housing in which the air intake is provided. If such an air intake is mounted on the front of the side walls of the housing of an aircraft chaff dispenser, the risk of the packets of chaff being sucked back into or recirculated inside the dispenser is therefore minimized and at the same time the risk of entry of the gases emitted by the missiles launched by the aircraft and therefore of damage to the packets of chaff contained inside the dispenser is minimized.

Moreover, owing to the small height of the fences of the lateral air intakes, both the aerodynamic drag and the radar visibility of the dispenser are reduced.

BRIEF DESCRIPTION OF THE DRAWINGS

The characteristics and advantages of the invention will result more clearly from the following detailed description provided purely by way of non-limiting example, with reference to the accompanying drawings in which.

DETAILED DESCRIPTION OF THE PREFERRED EMBODIMENTS

Figure 1:
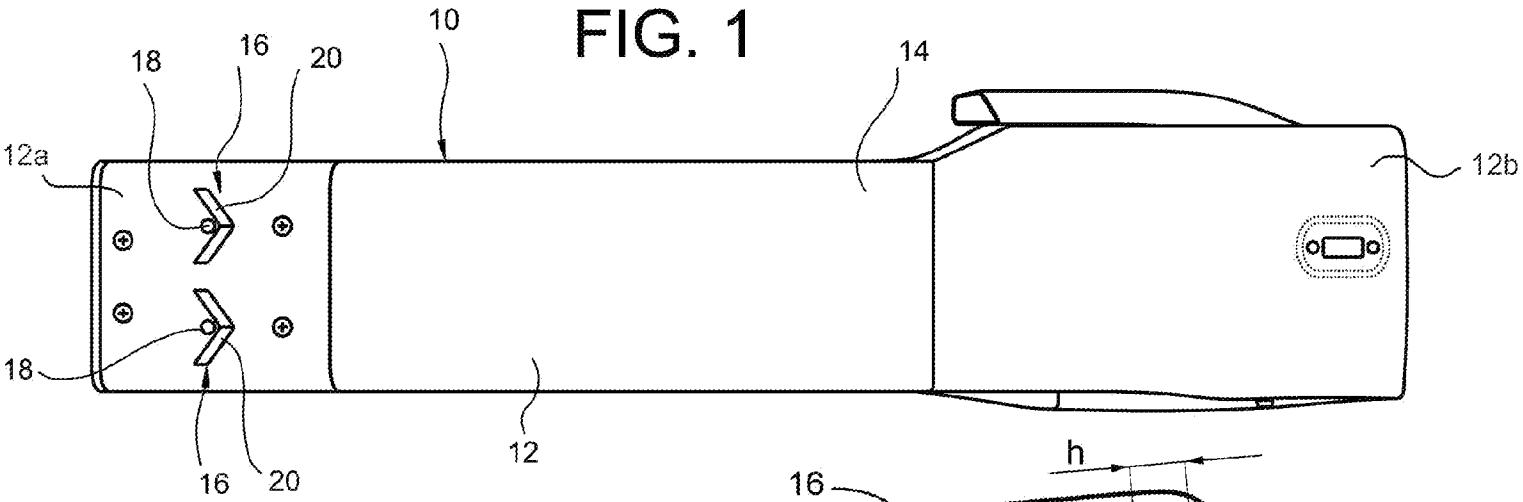
FIG. 1 is a side view of an aircraft chaff dispenser according to the present invention.

With reference initially to FIG. 1, an aircraft chaff dispenser according to the present invention is generally indicated 10 and basically includes:

an elongated hollow housing 12 intended to be fixed to the fuselage or to a wing of the aircraft so as to be oriented in the longitudinal direction of the aircraft, the housing having a closed front end 12*a* and an open rear end 12*b;* a driving mechanism (known per se and not shown) received inside the housing 12 and operable to push backwards (relative to the direction of travel of the aircraft) packets of chaff (known per se and not shown) so as to eject them one at a time from the rear opening 12*b*; and an electronic circuit controlling the driving mechanism, and, where applicable, part of the aircraft defence sensor equipment and electronic circuitry (known per se and not shown).

The housing 12 has preferably a square or rectangular cross-section with a pair of vertical side walls 14 (only one of which is shown in the figures), in the front part of which (left-hand side when viewing FIG. 1) at least one lateral air intake 16 is provided. Preferably, each side wall 14 of the housing 12 is provided with two lateral air intakes 16 which are vertically aligned. Each lateral air intake 16 comprises a through-hole 18, having preferably a circular shape with a diameter d, and a fence 20 located behind the hole 18 in the longitudinal direction (direction of travel) of the aircraft at a distance 1 from the centre of the said hole and having the form of a horizontally lying V with its vertex directed away from the hole 18, i.e. towards the tail of the aircraft. The height of the fence 20 is indicated h.

The shape of the fence 20 in the form of a horizontally lying V has the effect of causing the air flow to stop at the total pressure in the zone of the vertex of the V and therefore increasing the pressure at the front of the housing 12 of the dispenser, with consequent minimization of the risks of the ejected packets of chaff being sucked back inside the housing.

Figure 3:
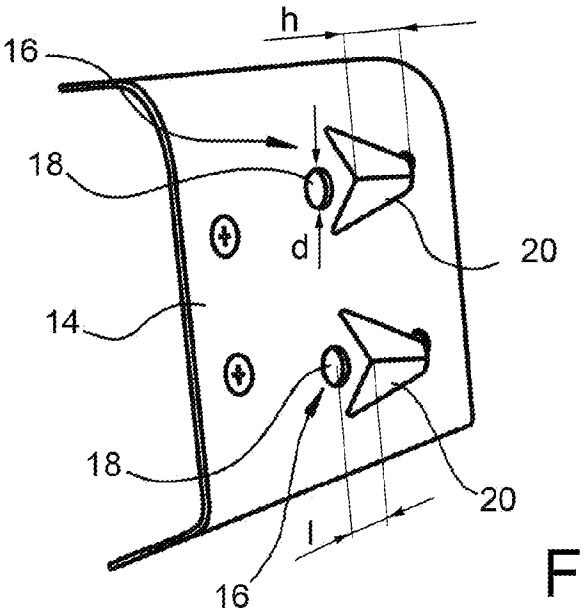
FIGS. 2 and 3 are perspective views which show each a respective embodiment of the lateral air intakes of an aircraft chaff dispenser according to the present invention.
Figure 2:
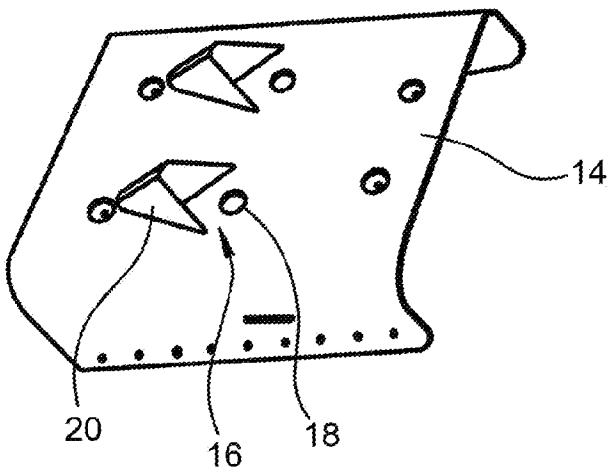

During tests it has been found that the best compromise between the need to supply air to the front of the dispenser housing in order to ensure a positive pressure gradient between the front and rear of the dispenser housing and the need to prevent entry of the gases emitted by the missiles launched by the aircraft and the consequent damage to the packets of chaff contained inside the dispenser is obtained by suitably defining the geometric characteristics of the lateral air intakes 16. In particular, it has been found that the geometric characteristics which most influence the performance of the lateral air intakes 16 are the three parameters indicated above, i.e. the diameter d of the hole 18, the distance 1 between the vertex of the fence 20 and the centre of the hole 18 and the height h of the fence 20 at its vertex. These parameters must be linked to each other by the following mutual relationships: the ratio h/1 must be between 0.8 and 1, while the ratio h/d must be between 1.5 and 2, with a diameter d between 8 and 12 mm. In the embodiment shown in FIG. 2, the diameter d is equal to 8 mm, the distance 1 is equal to 15 mm and the height h is equal to 15 mm, so that the ratio h/1 is equal to 1 and the ratio h/d is equal to 1.875. In the embodiment shown in FIG. 3, the diameter d is equal to 10 mm, the distance 1 is equal to 15 mm and the height h is equal to 15 mm, so that the ratio h/1 is equal to 1 and the ratio h/d is equal to 1.5.

While the housing 12 of the chaff dispenser 10 is made of metallic material, the fences 20 are preferably made of plastic (allowing the weight of the dispenser to be kept low) and fixed to the housing 12 by means of gluing.

Naturally, the principle of the invention remaining unchanged, the embodiments and the constructional details may be widely varied with respect to those described and illustrated purely by way of non-limiting example, without thereby departing from the scope of the invention as defined in the accompanying claims.

For example, although the invention has been described and illustrated with reference to application of the air intakes to an aircraft chaff dispenser, it is clear that the invention is applicable to any housing in which the pressure must be increased by the flow of air through an air intake, while minimizing at the same time the entry of external air.

As regards more specifically the shape of the air intake, the hole 18 may have a shape other than a circular shape, in particular a polygonal shape which can be traced around a circumference, in which case the abovementioned diameter d is the diameter of the circumference inscribed within the polygonal perimeter of the hole.

The invention claimed is:

1. Air intake comprising a through-hole formed in a wall of a housing and a fence located behind the hole relative to a direction of travel of the housing, the fence having a shape in the form of a horizontally lying V with its vertex directed away from the hole and projecting away from the wall to have a height at the vertex of the V;

wherein the ratio of the height of the fence at the vertex of the V to the distance between the vertex of the V and a center of the hole is between 0.8 and 1, and wherein the ratio of the height of the fence at the vertex of the V to the diameter of the hole is between 1.5 and 2.

2. Air intake according to claim 1, wherein the diameter of the hole is between 8 and 12 mm.

3. Air intake according to claim 1, wherein the fence is made of plastic.

4. Aircraft chaff dispenser comprising an elongated hollow housing configured to be fixed to structure of an aircraft said elongated hollow housing oriented a longitudinal direction or in the direction of travel of the aircraft, the housing having a pair of side walls, the front part B of the sidewalls being provided with at least one air intake according to claim 1.

5. Chaff dispenser according to claim 4, comprising two air intakes which are vertically aligned.

6. Chaff dispenser according to claim 4, wherein the fence is fixed to the housing by gluing.

7. Aircraft comprising a chaff dispenser according to claim 4.

* * * * *